US008415646B2

(12) United States Patent
Tombrello, Jr. et al.

(10) Patent No.: US 8,415,646 B2
(45) Date of Patent: Apr. 9, 2013

(54) PRODUCTION OF MEV MICRO BEAMS OF PROTONS FOR MEDICAL APPLICATIONS

(75) Inventors: Thomas Anthony Tombrello, Jr., Altadena, CA (US); Eran Nardi, Ramat Gan (IL)

(73) Assignee: California Institute of Technology, Pasadena, CA (US)

( * ) Notice: Subject to any disclaimer, the term of this patent is extended or adjusted under 35 U.S.C. 154(b) by 6 days.

(21) Appl. No.: 13/253,988

(22) Filed: Oct. 6, 2011

(65) Prior Publication Data

US 2013/0032731 A1 Feb. 7, 2013

Related U.S. Application Data

(60) Provisional application No. 61/515,258, filed on Aug. 4, 2011.

(51) Int. Cl.
*G21G 5/00* (2006.01)

(52) U.S. Cl.
USPC ..... 250/492.3

(58) Field of Classification Search ..... 250/492.3
See application file for complete search history.

(56) References Cited

U.S. PATENT DOCUMENTS

2010/0284502 A1* 11/2010 Piefer ..... 376/190
2011/0096887 A1* 4/2011 Piefer ..... 376/193

* cited by examiner

*Primary Examiner* — Kiet T Nguyen
(74) *Attorney, Agent, or Firm* — Milstein Zhang & Wu LLC; Joseph B. Milstein

(57) ABSTRACT

A proton beam guidance apparatus and a method of providing proton beams having sub-micron beam width and MeV energies. The apparatus is a structure having an enclosed channel that can reflect or guide protons by grazing incidence interactions. The enclosed channel is in some embodiments an annular channel. The enclosed channel is shaped to provide a helical path for each proton in the beam. Protons are provided to an input port of the channel, and after multiple grazing incidence interactions with the walls of the channel, are provided as an output beam having dimensions comparable to the cross sectional dimensions of the channel. The channels can have cross sectional dimensions of tens of nanometers or less. No externally applied electromagnetic fields are needed to guide the proton beam. Contemplated applications include use of the exit proton beams to provide medical treatment to patients.

20 Claims, 7 Drawing Sheets

PRODUCTION OF MEV MICRO BEAMS OF PROTONS FOR MEDICAL APPLICATIONS

CROSS-REFERENCE TO RELATED APPLICATIONS

This application claims priority to and the benefit of U.S. provisional patent application Ser. No. 61/515,258 filed Aug. 4, 2011, which application is incorporated herein by reference in its entirety.

FIELD OF THE INVENTION

The invention relates to beam guiding apparatus in general and particularly to a proton beam guiding apparatus that does not require an applied electromagnetic field to control the beam.

BACKGROUND OF THE INVENTION

Since the 1960s a small but stable element in radiation therapy has involved MeV ion beams. At Lawrence Berkeley Laboratory and Harvard University (and subsequently many other places) accelerators previously used for nuclear physics pioneered the use of this technique. Proton therapy as well as ion beam therapy have become very effective therapeutic tools and are becoming more and more widespread worldwide. In the LA area, the group at Loma Linda Hospital has established a solid reputation for their cancer treatment program, which is based on high energy (MeV) proton beams.

One substantial advantage of such ion beams is that the radiation dose is more localized than for x-rays or electrons. The reduction of the scattering of the beam permits irradiation volumes with sharper boundaries. In particular the Bragg peak at the end of the range permits a relatively high dose to the region of interest.

Bent crystals have been efficiently used for channeling of GeV particle beams at accelerators, as described by V. M. Biryakov, Yu. A. Chesnokov & V. I. Kotov, "Crystal Channeling and its Application at High Energy Accelerators," Springer, Berlin 1997.

There is a need for systems and methods that can provide proton beams having very narrow beam width.

SUMMARY OF THE INVENTION

According to one aspect, the invention features a proton beam guidance apparatus useful to provide a micro-beam of protons. The proton beam guidance apparatus comprises a proton beam guide having defined therein an enclosed channel having scattering centers located on an interior surface of the enclosed channel, the enclosed channel having an internal cross sectional dimension of tens of nanometers or less, the enclosed channel configured in the shape of a helix, the proton beam guide having an input port configured to accept protons from a proton source, and having an output port configured to provide a proton beam having a beam width of a dimension comparable to the internal cross sectional dimension of the enclosed channel. The proton beam is guided by scattering interactions with atomic scatterers on (or part of) the surface of the enclosed channel.

In one embodiment the proton beam guide is fabricated from a glass.

In a different embodiment the proton beam guide is fabricated from an insulator having a conductive coating applied to a surface of the insulator.

In one embodiment, the proton beam guide is fabricated from an electrically conductive material. The electrically conductive material can be a surface coating on a non-conducting material like glass.

In another embodiment, the electrically conductive material comprises a metal.

In yet another embodiment, the electrically conductive material comprises carbon. In some embodiments the carbon is present as a carbon nanotube.

In still another embodiment, the proton beam guide comprises a plurality of atoms having atomic number Z above 72 located on the interior surface of the enclosed channel surface of the enclosed channel.

In a further embodiment, the enclosed channel is an annular channel. In still another embodiment, the annular channel has a circular cross section.

According to another aspect, the invention relates to a proton beam guiding method. The method comprises the steps of providing a proton beam guide having defined therein an enclosed channel having scattering centers located on an interior surface of the enclosed channel, the enclosed channel having an internal cross sectional dimension of tens of nanometers or less, the enclosed channel configured in the shape of a helix, the proton beam guide having an input port configured to accept protons from a proton source, and having an output port configured to provide a proton beam having a beam width of a dimension comparable to the internal cross sectional dimension of the enclosed channel; applying a supply of protons having energy measured in tens to hundreds of MeV to the input port of the proton beam guide; and receiving from the output port of the proton beam guide a beam of protons having a beam width of comparable dimension to the internal cross sectional dimension of the enclosed channel. The proton beam is guided by scattering interactions with atomic scatterers on (or part of) the surface of the enclosed channel.

In one embodiment, the method further comprises the step of measuring the received proton beam with respect to one or more of a fluence, an energy, a dose, and a beam width.

In another embodiment, the guiding method further comprises the step of using the received proton beam to provide medical treatment to a patient.

In yet another embodiment, the proton beam guide is fabricated from a glass.

In a further embodiment, the proton beam guide is fabricated from an insulator having a conductive coating applied to a surface of the insulator.

In yet another embodiment, the proton beam guide is fabricated from an electrically conductive material. The electrically conductive material can be a surface coating on a non-conducting material like glass.

In still another embodiment, the electrically conductive material comprises a metal.

In a further embodiment, the electrically conductive material comprises carbon. In some embodiments the carbon is present as a carbon nanotube.

In yet a further embodiment, the proton beam guide comprises a plurality of atoms having atomic number Z above 72 located on the interior surface of the enclosed channel.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

The present description outlines a class of apparatus and a method for creating submicron beams of 20 MeV protons for very localized medical treatment, which is expected to achieve sub-micron dimension treatment regions. For ease of exposition, such apparatus will be referred to as a proton beam guidance apparatus. In other embodiments, the proton energies of interest range from tens to hundreds of MeV. The apparatus relies on a helical path (an enclosed channel) that comprises scattering sites provided by atoms. The enclosed channel is bent into a smooth curve (e.g., a portion of a circle) so that it guides the proton beam gradually and deflects the protons, so as to bend the proton beam. The proton beam undergoes atomic scatterings in this gradually curved enclosed channel, thus being deflected.

In a preferred embodiment, the atoms are heavy atoms such as tungsten (Z=74) and gold (Z=79), where Z represents atomic number, or number of protons present in the atomic nucleus. Other elements that are expected to be useful include Hf (Z=72), Ta (Z=73), Re (Z=75), Os (Z=76), Ir (Z=77) and Pt (Z=78). In general, elements having atomic number above 72 are expected to be good scatterers of protons, although some of them may have other properties that render them less preferable for use, such as chemical reactivity or radioactive properties.

The use of a helical path provides a way to create such submicron beams that uses no electromagnetic focusing elements near the site of the irradiation, which makes it substantially more flexible to use in practice. Another contemplated application of these beams lies is in the very active field of microbeam irradiation of individual and bystander cells.

Two contemplated applications include using proton beams in highly localized cancer therapy treatment and using the nanometer dimension proton beams for studying the irradiation effects inside individual cells on the submicron scale as well as the effect of this irradiation on nearby cells. Another contemplated application is a method of digging trench profiles, e.g. nanogrids, using particles transmitted through such nanopipes or nanotubes.

As explained in the following description, we exploit the phenomenon of "channeling", in which ions are steered by grazing collisions with the atoms in a crystalline lattice or with atoms aligned along a desired propagation path. Recently, nanotubes made from elements heavier than carbon permit channeling to be used to steer high energy ion beams which can have application in cancer therapy, among other potential uses. Based on the results of our simulations, we expect this to be successful.

The Helix

Parametric equations are convenient for describing curves in higher-dimensional spaces. A helix can be represented by the three equations Eqn (1)-Eqn (3) using the parameter t (for example representing time).

$$x=\alpha\cos(t) \quad \text{Eqn (1)}$$

$$y=\alpha\sin(t) \quad \text{Eqn (2)}$$

$$z=bt \quad \text{Eqn (3)}$$

Figure 1:
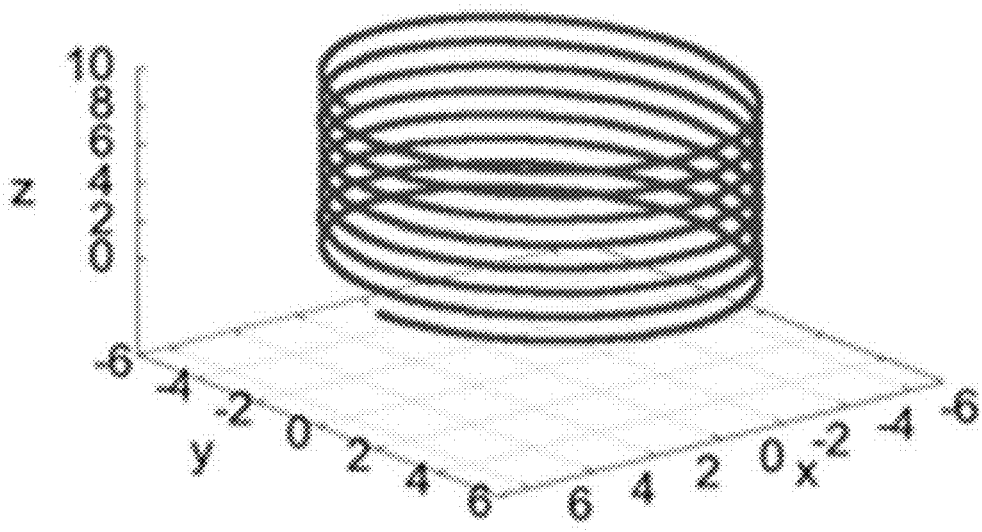
FIG. 1 PRIOR ART
FIG. 1 is a perspective view of a graph of a helix with x y, and z axes shown in a right-handed coordinate system.

The helix represented by Eqn (1)-Eqn (3) has a radius of a units and rises by $2\pi b$ units per turn. FIG. 1 is a diagram illustrating a helix. Equations (1) and (2) are the equations that can be used to represent circular motion in a plane. Equation (3) provides a linear change in the value of z with time. The helix can also be represented in parametric form as $$r(l)=(x(l),y(l),z(l))=(\alpha\cos(l),\alpha\sin(l),bl). \quad \text{Eqn (4)}$$

We have investigated by simulation the possibility of bending and steering proton beams of medical and biological interest by means of high atomic number (Z) metallic nanotubes. The proton energies involved here are of the order of tens of MeV. A particularly interesting application of this research lies in the delivery of therapeutic proton beams to tumors, as well as for producing beams for single cell level studies of proton irradiation effects. The metallic nature of the nanotube is of importance, as will be discussed below.

Model

A computer program has been written which describes the following situation. The results obtained in using the computer program to model the interaction of a proton beam with an annular guiding structure are described hereinafter.

In the model employed here, a nanotube having atomic scattering sites situated at the inner surface of an annular channel in the shape of a helix of atoms is used as a guide for a beam of energetic protons. As presently contemplated, the nanotube can be fabricated from a single chemical substance, such as a metal; from a compound chemical substance, such as an oxide glass; or from a combination of substances, such as a support fabricated from a material such as carbon (e.g., a carbon or graphene nanotube) that is decorated with heavy atoms that serve as scattering sites on the inner surface of the annular volume.

The nanotube has been approximated by a long thin annulus that takes the form of a helix, on which the target atoms are spread out in a screw-like manner. For simplicity, the annulus, which has a centerline which describes a helix, may be referred to as a helix. The atoms are approximated by spheres, with which the protons interact, and are repelled gently, since the collisions are essentially grazing collisions. In a further analysis, packets of annular nanotubes that are each bent into helical configuration, and that are adjacent to each other, have also been modeled.

In one model, a single bent glass capillary tube is represented by alternating Si and O atoms wrapped around a helix in rings, in a screw like manner. The atoms in the calculation are represented by small spheres of radius 0.7 A. The radius of the ring is 50 A, while 200 atoms are spread out in an equally spaced manner along the circumference of the ring. Thus, the distance between the center of an atom to the center of its nearest neighbor is 1.57 A, close to the value of 1.6 A in glass. The distance between the centers of the advancing rings along the screw like helix is 2 A.

In the present calculation the binary collision approximation is used, with protons interacting individually with each target atom they encounter. This approximation is widely used in the literature in connection with channeling as well as radiation defect studies. See for example M. T. Robinson & I. M. Torrens, Physical Review B 9, 5008 (1974) and A. Mertens & H. Winter, Phys. Rev. Lett. 85, 2825 (2000). A simplified screened potential was used, denoting b as the impact parameter and R the atomic radius of the scatterer, the scattering angle θ is given by Eqn (5), discussed by I. Nagy et al., Phys. Rev. A 78 012902 (2007), $$\tan^2(\theta/2)=[Ze^2/(bmv^2)]^2[(1-(b/R)^2]/[1-(Ze^2/R)*mv^2]^2 \quad \text{Eqn (5)}$$

Omitting the second term in square brackets on the right hand side (RHS) gives the Rutherford scattering formula for a bare charge. After traversing the atomic sphere, the proton is deflected by the angle θ in the direction normal to its trajectory. The change of the angle is carried out in the plane of the incoming proton trajectory and the line connecting the center of the sphere to the point where the proton leaves the sphere.

The bending radius of the helix in the present calculation is $R_b$=10 cm, the proton energy is 20 MeV, while the radius of the rings comprising the helix is $R_h$=5 nm. The proton initially moves in the z direction, the direction of the initial major axis of the helix, with a very slight inclination angle Θ towards the x direction. The calculation is initiated by forcing the proton to interact with the first atom of the helix at its external edge.

As discussed in T. Nebiki et al., Nucl. Instrm. & Meth. B 266, 1324 (2008), it is believed that the charging-up of the capillary tube walls will be minimized. It is believed that the charging effect on the particle trajectory is negligible for the problems encountered here. Thus, particle deflection is only achieved by small angle scattering with the atoms comprising the helix.

In one embodiment, the helix is assumed to be made up of gold (Au) atoms. As will be further explained, a structure having an annulus that has a centerline that describes a helix can have heavy atoms of other elements on its inner surface. The helical annulus itself does not have to be constructed exclusively of heavy atoms, but can have heavy atoms present on its inner surface, so long as sufficient heavy atoms are present at the required locations on the inner surface. The scattering angle is calculated in accordance with a screened Coulomb scattering law, assuming a binary collision model with each of the atoms on the helix. The program searches for the next interaction with a given atom on the helix and continues this procedure until the proton escapes the helix. In one embodiment, protons that escape by passing through the wall of the helix, or protons that are scattered out of the tube, can be "caught" by an adjacent tube and will continue to propagate. An investigation of the latter step has been made.

Figure 2:
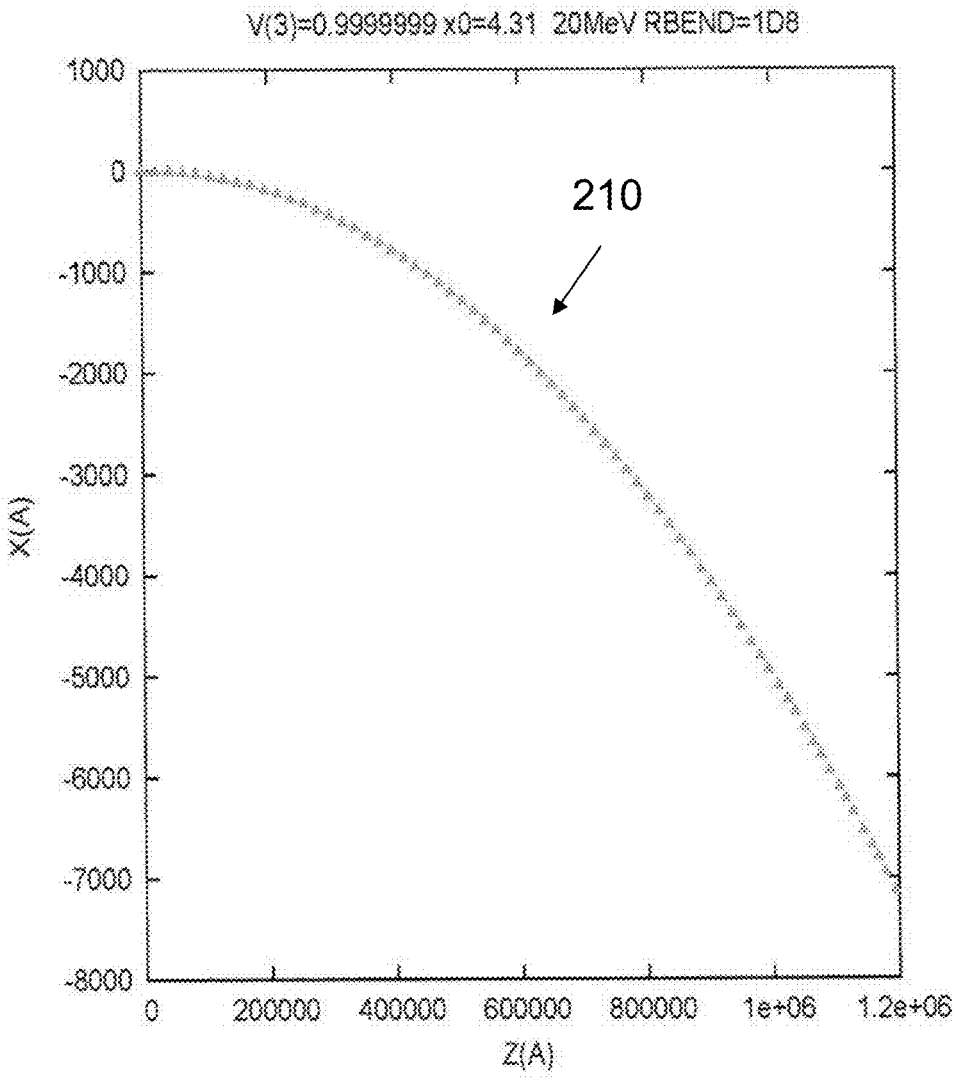
FIG. 2 is a graph illustrating the calculated path of propagation of a 20 MeV proton within a bent helix of Au scattering atoms, with bending radius of $10^8$ Angstrom (1 cm), which operates according to principles of the invention. The diameter of the helix is 10 Angstroms (1 nm).

In FIG. 2 we plot the propagation of a 20 Me V proton as curve 210 within an annulus that is helical in shape, with a bending radius of $10^8$ Angstrom (1 cm). The diameter of the annulus is 10 Angstrom. The proton enters the helical annulus as shown in FIG. 2 at an angle of 0.026 degrees with respect to the z axis, where it interacts with the first atom on the surface (for example the top side) of the helical annulus at the inward edge of the atomic sphere. FIG. 2 demonstrates for this specific problem, the successful guiding of the proton up to 120 microns in the direction of propagation while being bent by almost 7000 Angstroms in the transverse direction. For the example illustrated in FIG. 2, the calculation terminated due to memory constraints. It is believed that in the absence of the memory constraints, it would have been observed that the proton could have continued to propagate. It is observed that by decreasing the angle of incidence, the proton penetration and bending increases further and further. Note that this has model indicates that this propagation can be accomplished without magnets or strong external fields.

In one embodiment, the capillary can be a glass capillary tube. We have demonstrated by modeling that 20 MeV protons can be guided within a 10 nm diameter helical tube, for a distance of 0.55 cm, with the beam bending in the transverse direction by 0.16 mm. It is expected that larger distances of travel of the beams will be achievable.

We show at first on a local scale how the proton oscillates from one side of the capillary to the other, also clarifying the geometry of the problem.

Figure 3A:
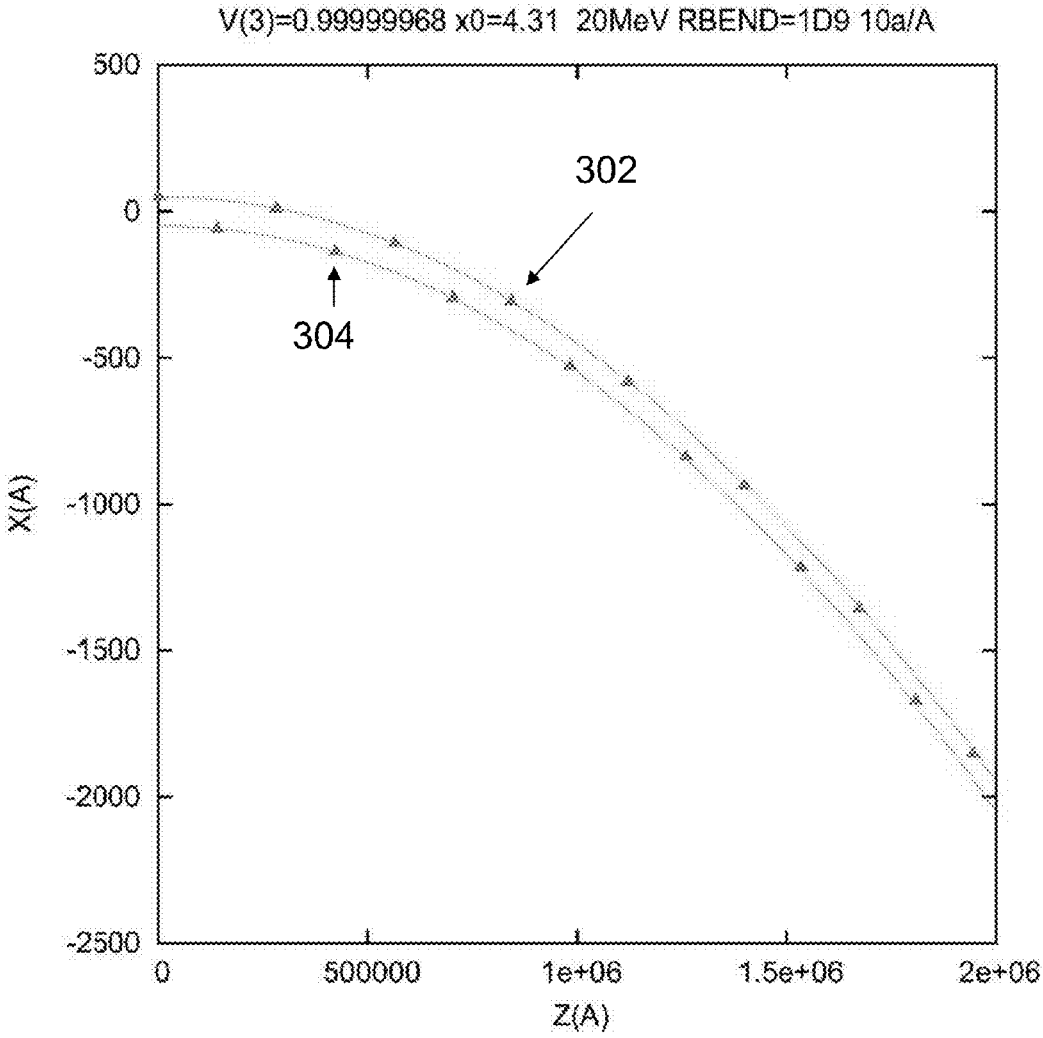
FIG. 3A is a graph of the initial part of the path of the incoming proton, showing the points of interaction (indicated by triangles) with the bending helix on which the atomic scatterers are placed. The curves representing the top and bottom of the helix are shown in the figure.
Figure 3B:
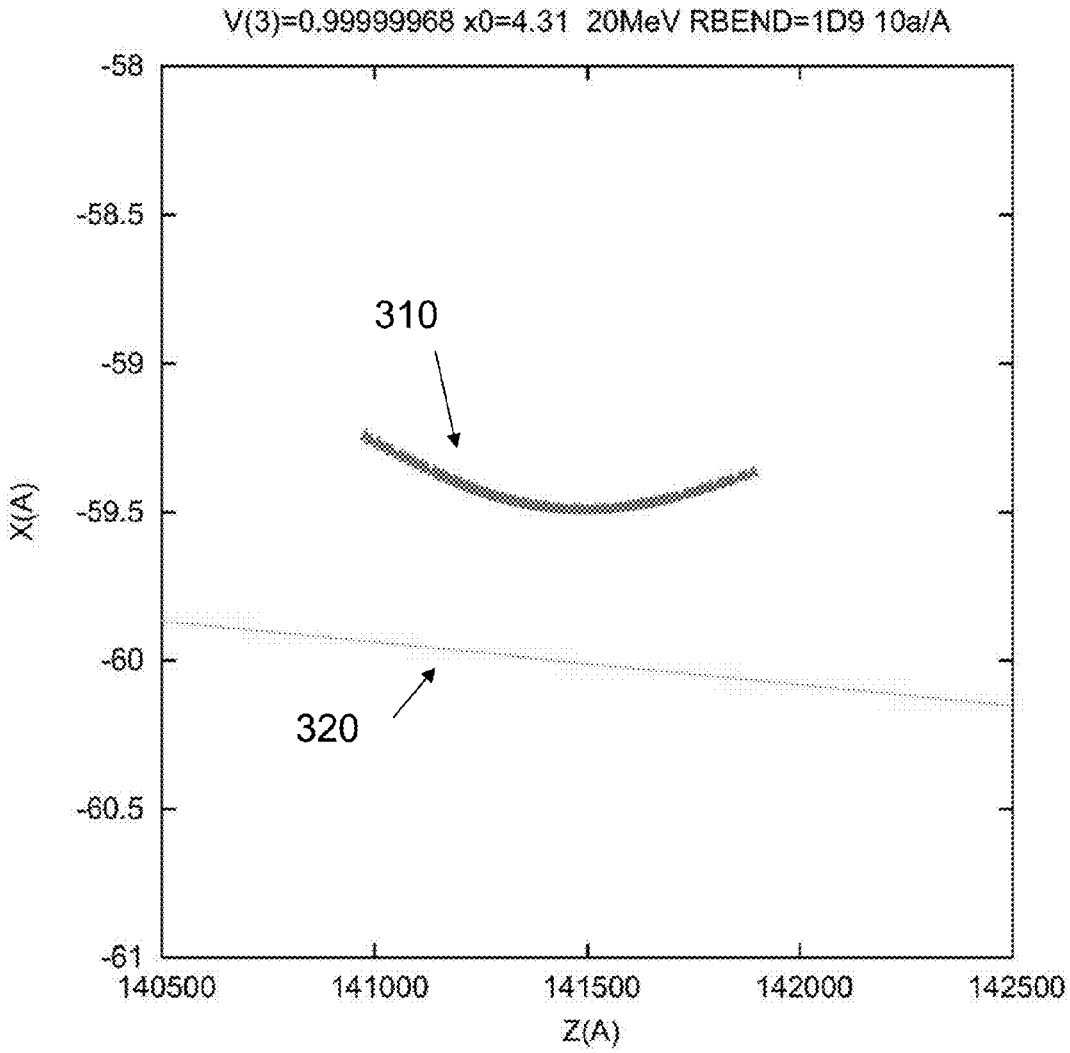
FIG. 3B is a graph showing the details of the second interaction point, the first point on the bottom of the helix. The model takes into account proton motion that comprises 226 individual interactions with adjacent spheres representing atoms. The centers of the spheres are placed on the curve denoting the helix.

FIG. 3A gives the initial part of the path of the incoming proton, showing the points of interaction with the helix of scatterers. Curve 302 represents the upper side of the annular helix and curve 304 represents the lower side of the annular helix. Triangles on each curve represent the location of scatterers. The second point of interaction, the first at the bottom line of the helix, is modeled using 226 individual interactions between a proton and a scatterer. A blowup of this interaction is given in FIG. 3B, where the proton motion, represented by solid triangles 310, is plotted as the proton approaches the lower surface of the helix, represented by line 320, and is then repelled, after which it interacts with the other (top) side of the helix.

Figure 4:
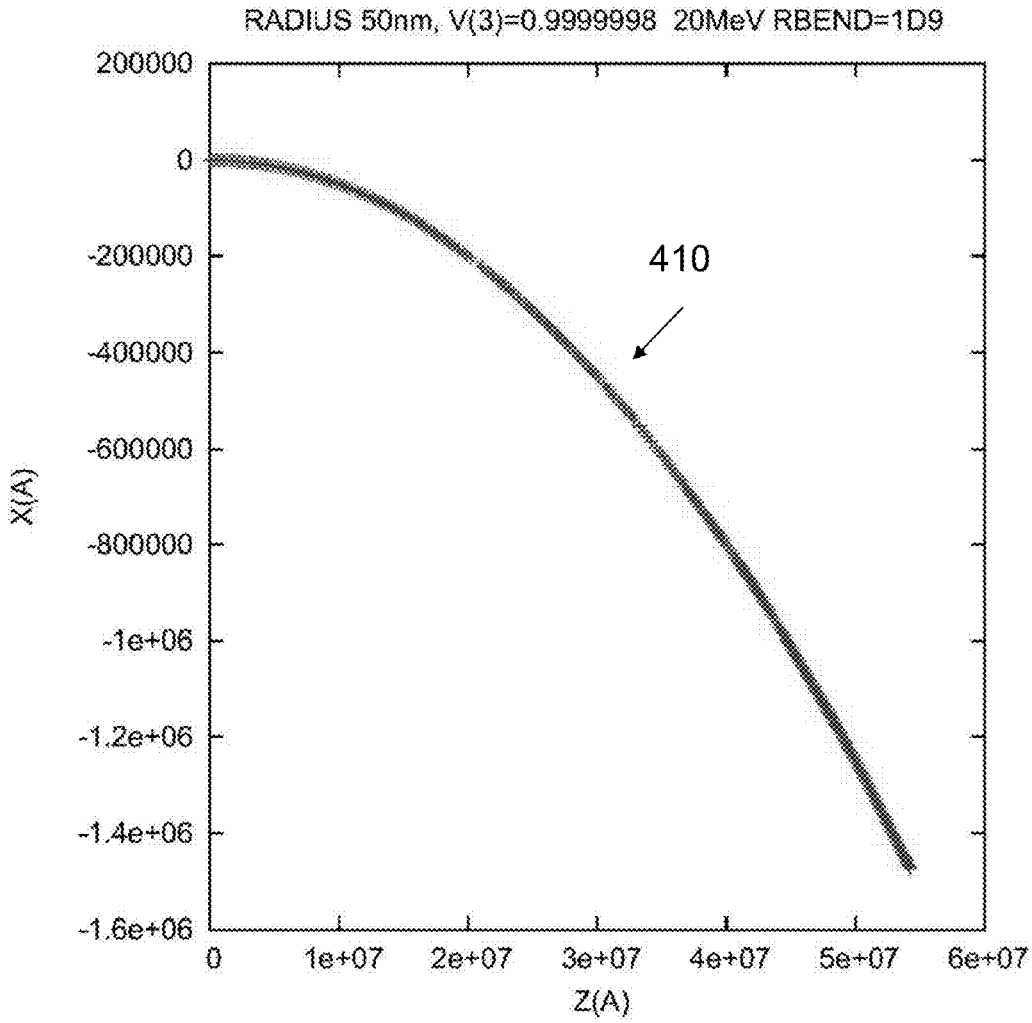
FIG. 4 is a graph showing the calculated path of a 20 MeV proton within a 10 nm diameter glass helix of atomic scatterers, up to the point where it is scattered out of the helix. The bending radius of the helix is 10 cm while the initial angle of inclination with the z axis is 0.036 degrees.

The parameter in the results presented here below is the initial inclination angle, Θ, of the incoming proton trajectory with the z axis. The result for 0.036 degrees is presented in FIG. 4, where the line 410 represents the path of the proton within the helix. This path comprises 67,100 individual interactions with different target atoms along the bent helix. The striking feature here is the deep penetration of the beam of up to 0.55 cm, with the beam bending in the transverse direction by 0.16 mm. These calculations show that substantial penetration of a proton beam even in strongly bent glass capillaries could be obtained.

Figure 5:
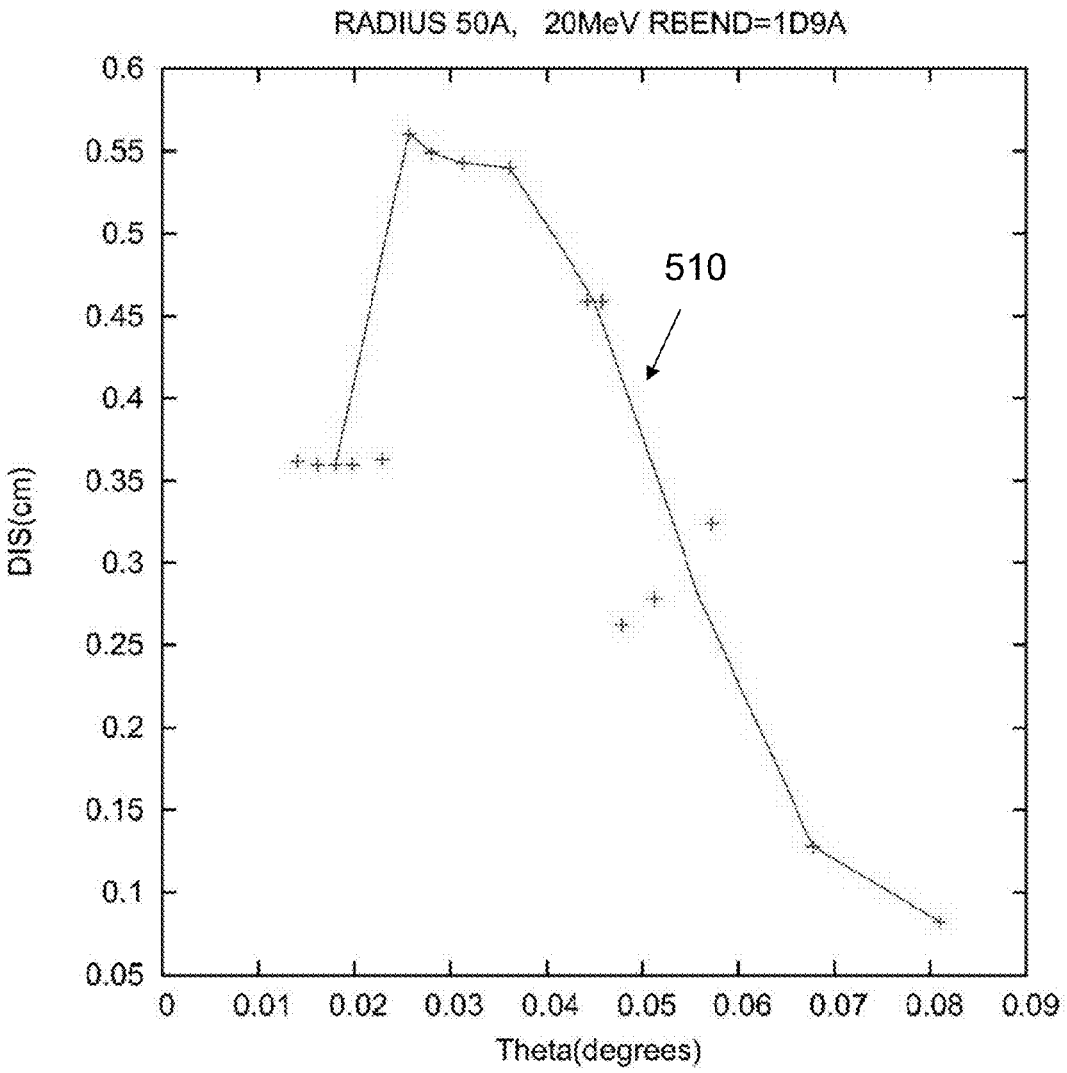
FIG. 5 is a graph showing the penetration length of a 20 MeV proton beam within a 10 nm diameter bent glass helix, as a function of the incident proton angle with the z axis. The bending radius of the helix is 10 cm. In addition to the data points, a smooth curve is provided to guide the eye.

In FIG. 5 we present the proton penetration length as a function of the initial inclination angle Θ. In addition to the data points, a smooth curve 510 is provided to guide the eye. As expected, the depth of penetration decreases with increasing Θ, at relatively large initial inclination angles. However, decreasing Θ below 0.03 degrees, causes the penetration distance to decrease to 0.3 cm. This result indicates that there is a well-defined acceptance angle for propagation of protons through the annular nanotube.

Figure 6:
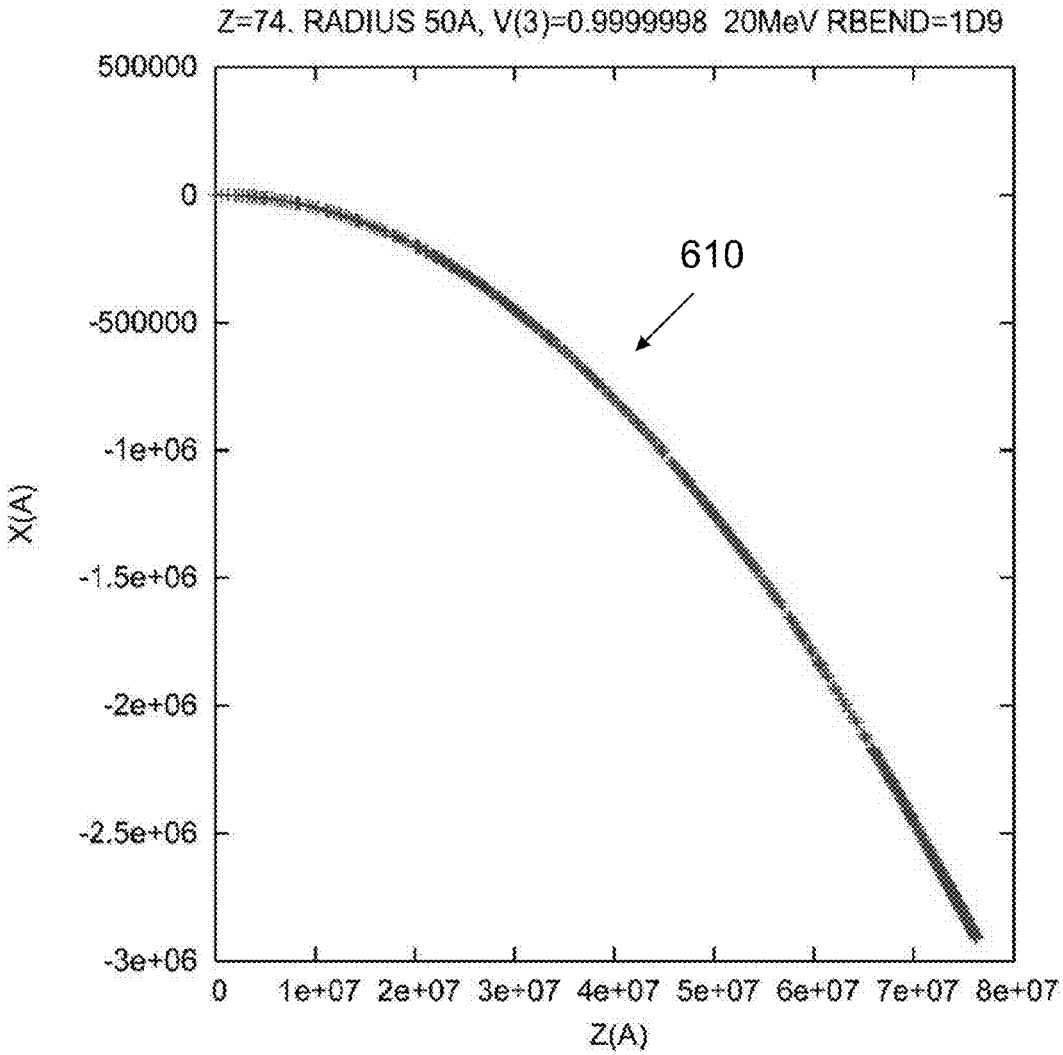
FIG. 6 is a graph showing the calculated path of a 20 MeV proton within a 10 nm diameter helix of tungsten atoms that operates according to principles of the invention.

FIG. 6 is a graph showing the calculated path 610 of a 20 MeV proton within a 10 nm diameter helix of tungsten atoms that operates according to principles of the invention.

A subsequent step introduces adjacent surrounding nanocapillaries and in so doing constructing a bundle of capillaries. In such a configuration, it is expected that protons leaving the central capillary can be captured in and transported by any of the surrounding adjacent capillaries. A calculation in which a ring of six parallel capillary tubes surrounded the central tube was carried out. In some of the cases studied, capture occurred, with maximum transmitting path lengths of the order of 0.1 μm until the proton scattered out of the second capillary. This could be understood, since deep penetration occurs only at very small grazing angles. However, we cannot rule out the important possibility, that with several hundred surrounding capillaries, appreciable additional transport could be obtained. A multi-capillary system similar to the well-known neutron and X-ray lenses, could be of particular importance. Specifically, if the bent capillaries are arranged in a pattern, such as a circular pattern, so that all transmitted nanobeams point at the same focus of nanometer size, one might be able to enhance the focal proton beam intensity greatly.

While the present disclosure provides an analysis for a proton beam guidance apparatus having an annular (e.g., circular cross section) channel shaped as a helix, it is expected that an enclosed channel of a different cross sectional shape, having two opposed reflective surfaces at a top surface and a bottom surface of the channel, could also be used to provide a similar proton beam guidance apparatus. For example, an enclosed channel shaped as a helix having a square cross section, or a hexagonal cross section, could also serve to construct a proton beam guidance apparatus according to principles of the invention.

After a proton beam has traversed the proton beam guidance apparatus, there can be reasons to measure some of the properties of the exit beam. The measurements can include measuring the received proton beam with respect to one or more of a fluence, an energy, a dose, and a beam width. The results of the measurement can be used to control the beam so that a patient is given appropriate treatment. In one embodiment, the measurements can be made by first placing the measurement apparatus in the location where the patient would be situated, and after confirming that the beam is operating as intended, removing the measurement apparatus and placing the patient in position to be treated.

Applications

We now enumerate some of the medical and biological applications of the proposed metallic proton guiding nanotube, which we believe to be novel.

Radio Surgery Applications

One goal is to be able to deliver proton or ion beam radiation to a specific destination. Healthy tissues would be expected to absorb less radiation using this delivery method as compared to conventional proton therapy of tumors, because the sharper definition of the proton beam allows it to avoid more precisely healthy tissues surrounding the tumor. We believe that this is a novel form of brachytherapy, with the advantage of no need for radioactive sources. The dose and range could also be more accurately controlled than with the cumbersome and difficult to handle radioactive source. Electrical feedback of irradiated areas by using a conductive nanotube as both a delivery apparatus and a probe is expected to be of additional value. It is our expectation that the systems and methods disclosed put a radiation scalpel in the hands of a radiologist or surgeon.

Microbeam Irradiation of Individual Cells

Investigations of the radiation action on cells at the submicron scale have been a very active field of research for over the past 15 years. We have investigated by modeling the effects of radiation in individual cells, permitting also the possibility of investigation on the subcellular level, as well as on the non-targeted bystander cells. The current methods struggle with collimation of such fine beams, using glass capillaries which give beams having a diameter of the order of microns, for example as described by N. Stoltefoht et al. "Dynamic properties of ion guiding through nanocapillaries in an insulating polymer", Phys. Rev. A 79, 022901 (2009). Glass capillaries also have the disadvantage that they fluoresce under irradiation. In addition most publications deal with KeV energy beams, with pronounced oscillations in the time evolution of the transmission profiles. Electromagnetic collimation is now also being attempted.

Additional papers on similar research include N. Stoltefoht et al., Phys. Rev. A 76, 022712 (2007) and T. Ikeda et al., J. Phys. Conf. Series, 88, 012031 (2007).

Besides the much smaller beam size, the conductive tube described here would be favorable since the proton emitting needle has a well-defined potential, thus avoiding disturbing bio-effects on neighboring living matter, which might arise by the electrostatic charging up of the tube. In some embodiments the tube can be metallic. In some embodiments the tube can be made of carbonaceous material such as carbon nanotubes or grapheme. Furthermore, in parallel to proton injection, the conductive tube can be used to probe the local potential and currents in the biological samples at the point of proton impact. These possibilities also apply to therapeutic applications, as will be discussed below.

Production of metallic nanotubes has been and is an active area of research. In particular, both gold and platinum (Pt) serve our purpose well. Gold tubes having a diameter of 1 nm and about 6 microns of length have been fabricated, as described in C. R. Martin et al. "Investigations of the transport properties of gold nanotube membranes" J. Phys. Chem. B 105, 1925 (2001). It is expected that heavy metal nanotubes of tens of microns and more in length will be readily available in the near future.

Advantages of such narrow conductive tubes include better definition of beam diameter than wider tubes, and absence of fluorescent signal from conductive tubes. These advantages can be expected to provide better physical resolution with regard to beam impingement, and the possibility of sensing fluorescence from irradiated samples without having to separate those signals from spurious fluorescence generated by interaction of the beam with the tube.

Definitions

Unless otherwise explicitly recited herein, any reference to an electronic signal or an electromagnetic signal (or their equivalents) is to be understood as referring to a non-volatile electronic signal or a non-volatile electromagnetic signal.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A proton beam guidance apparatus useful to provide a micro-beam of protons, comprising:

a proton beam guide having defined therein an enclosed channel having scattering centers located on an interior surface of said enclosed channel, said enclosed channel having an internal cross sectional dimension of tens of nanometers or less, said enclosed channel configured in the shape of a helix, said proton beam guide having an input port configured to accept protons from a proton source, and having an output port configured to provide a proton beam having a beam width of a dimension comparable to said internal cross sectional dimension of said enclosed channel.

2. The proton beam guidance apparatus of claim 1, wherein said proton beam guide is fabricated from a glass.

3. The proton beam guidance apparatus of claim 1, wherein said proton beam guide is fabricated from an insulator having a conductive coating applied to a surface of said insulator.

4. The proton beam guidance apparatus of claim 1, wherein said proton beam guide is fabricated from an electrically conductive material.

5. The proton beam guidance apparatus of claim 4, wherein said electrically conductive material comprises a metal.

6. The proton beam guidance apparatus of claim 4, wherein said electrically conductive material comprises carbon.

7. The proton beam guidance apparatus of claim 6, wherein said electrically conductive material that comprises carbon is a carbon nanotube.

8. The proton beam guidance apparatus of claim 1, wherein said proton beam guide comprises a plurality of atoms having atomic number Z above 72 located on said interior surface of said enclosed channel.

9. The proton beam guidance apparatus of claim 1, wherein said enclosed channel is an annular channel.

10. The proton beam guidance apparatus of claim 9, wherein said annular channel has a circular cross section.

11. A proton beam guiding method, comprising the steps of:

providing a proton beam guide having defined therein an enclosed channel having scattering centers located on an interior surface of said enclosed channel, said enclosed channel having an internal cross sectional dimension of tens of nanometers or less, said enclosed channel configured in the shape of a helix, said proton beam guide having an input port configured to accept protons from a proton source, and having an output port configured to provide a proton beam having a beam width of a dimension comparable to said internal cross sectional dimension of said enclosed channel;

applying a supply of protons having energy measured in tens to hundreds of MeV to said input port of said proton beam guide; and receiving from said output port of said proton beam guide a beam of protons having a beam width of comparable dimension to said internal cross sectional dimension of said enclosed channel.

12. The proton beam guiding method of claim 11, further comprising the step of measuring said received proton beam with respect to one or more of a fluence, an energy, a dose, and a beam width.

13. The proton beam guiding method of claim 11, further comprising the step of using said received proton beam to provide medical treatment to a patient.

14. The proton beam guiding method of claim 11, wherein said proton beam guide is fabricated from a glass.

15. The proton beam guiding method of claim 11, wherein said proton beam guide is fabricated from an insulator having a conductive coating applied to a surface of said insulator.

16. The proton beam guiding method of claim 11, wherein said proton beam guide is fabricated from an electrically conductive material.

17. The proton beam guiding method of claim 16, wherein said electrically conductive material comprises a metal.

18. The proton beam guiding method of claim 16, wherein said electrically conductive material comprises carbon.

19. The proton beam guiding method of claim 18, wherein said electrically conductive material that comprises carbon is a carbon nanotube.

20. The proton beam guiding method of claim 11, wherein said proton beam guide comprises a plurality of atoms having atomic number Z above 72 located on said interior surface of said enclosed channel.

* * * * *